US011234544B2

(12) United States Patent
Rivera

(10) Patent No.: US 11,234,544 B2
(45) Date of Patent: Feb. 1, 2022

(54) INSULATED CUP HOLDER

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 768 days.

(21) Appl. No.: 15/338,354

(22) Filed: Oct. 29, 2016

(65) Prior Publication Data

US 2017/0119186 A1 May 4, 2017

Related U.S. Application Data

(60) Provisional application No. 62/248,958, filed on Oct. 30, 2015.

(51) Int. Cl.
*A47G 23/02* (2006.01)
*B65D 81/38* (2006.01)

(52) U.S. Cl.
CPC ..... *A47G 23/0233* (2013.01); *B65D 81/3881* (2013.01); *A47G 2023/0275* (2013.01)

(58) Field of Classification Search
CPC ..... B65D 81/3881; B65D 25/20; A47G 2023/0275
USPC ..... 220/592.24, 592.2, 62.11, 739
See application file for complete search history.

(56) References Cited

U.S. PATENT DOCUMENTS 2,727,645 A * 12/1955 Dore ..... A47G 23/03 215/393
3,090,478 A * 5/1963 Stanley ..... B65B 43/54 141/177
4,596,370 A * 6/1986 Adkins ..... B62J 11/00 224/414
5,361,604 A * 11/1994 Pier ..... B65D 81/3883 62/371
6,308,846 B1 * 10/2001 Muller ..... B65D 81/3841 215/13.1
6,367,652 B1 * 4/2002 Toida ..... B65D 25/2811 220/592.16
6,626,326 B2 * 9/2003 Murakami ..... B65D 81/3881 220/23.87
7,201,285 B2 * 4/2007 Beggins ..... B65D 81/3879 215/386
7,537,136 B2 5/2009 Hechmati
7,784,759 B2 * 8/2010 Farrell ..... B65D 81/3879 215/232
8,146,797 B2 4/2012 D'Amato
8,932,428 B2 1/2015 D'Amato
2004/0066705 A1 * 4/2004 Linz ..... A47J 43/27 366/130
2005/0029273 A1 2/2005 Hechmati
2005/0224504 A1 10/2005 Killoren et al.
2008/0006643 A1 * 1/2008 Ma ..... A47J 41/0011 220/592.16

(Continued)

FOREIGN PATENT DOCUMENTS

EP 2 641 840 A1 9/2013

*Primary Examiner* — Anthony D Stashick
*Assistant Examiner* — Raven Collins
(74) *Attorney, Agent, or Firm* — IP Strategies

(57) ABSTRACT

An insulated cup holder includes outer and inner walls separated by an empty volume, and a gap between a cup and the inner walls. A silicone ring at the top of the inner wall seals and holds the cup, and the inner walls are tapered to contact a base of the cup to seat the cup in the cup holder above an inner shell base, and the only contact between the inner shell and the cup walls is at the cup base.

23 Claims, 2 Drawing Sheets

(56) References Cited

U.S. PATENT DOCUMENTS

| | | | | |
|---|---|---|---|---|
| 2010/0108693 | A1 | 5/2010 | Zhang et al. | |
| 2014/0312040 | A1* | 10/2014 | Gamelli ..... | B65D 47/122<br>220/288 |

* cited by examiner

INSULATED CUP HOLDER

CROSS-REFERENCE TO RELATED APPLICATIONS

The present application claims the priority of U.S. Provisional Patent Application Ser. No. 62/248,958 filed Oct. 30, 2015, which application is incorporated in its entirety herein by reference.

BACKGROUND OF THE INVENTION

The present invention relates to cup holders and in particular to an insulated cup holder.

Generally, drinkers prefer drinks to be cold or hot. Such drinks are easily provided at a desired temperature, but depending on ambient temperature, the drinks may quickly lose the desired temperature. Known insulated cups provide some ability to retain temperature, but a desire remains for better insulation.

Known cup holders also result in the cup resting against the bottom of the holder. Such contact may either reduce the thermal insulation of the cup from the cup holder, and may provide instability when the cup holder is tilted while drinking, producing an uncomfortable sensation. A desire remains for a cup holder retaining the cup securely separated from the cup holder as much as possible.

BRIEF SUMMARY OF THE INVENTION

The present invention addresses the above and other needs by providing an insulated cup holder which includes outer and inner walls separated by an empty volume, and a gap between a cup and the inner walls. A silicone ring at the top of the inner wall seals and holds the cup, and the inner walls are tapered to contact a base of the cup to seat the cup in the cup holder above an inner shell base, and the only contact between the inner shell and the cup walls is at the cup base.

In accordance with one aspect of the invention, there is provided an insulated cup holder having an annular sealing and holding ring for engaging near the top of a cup residing in the cup holder.

In accordance with another aspect of the invention, there is provided a tapered inner wall inside an outer wall, tapering away from the outer wall towards the base of the holder and towards the base of a cup in the holder. The outer wall provides a stable base and the inner wall provides a contact ring for the cup held in the holder

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 2:
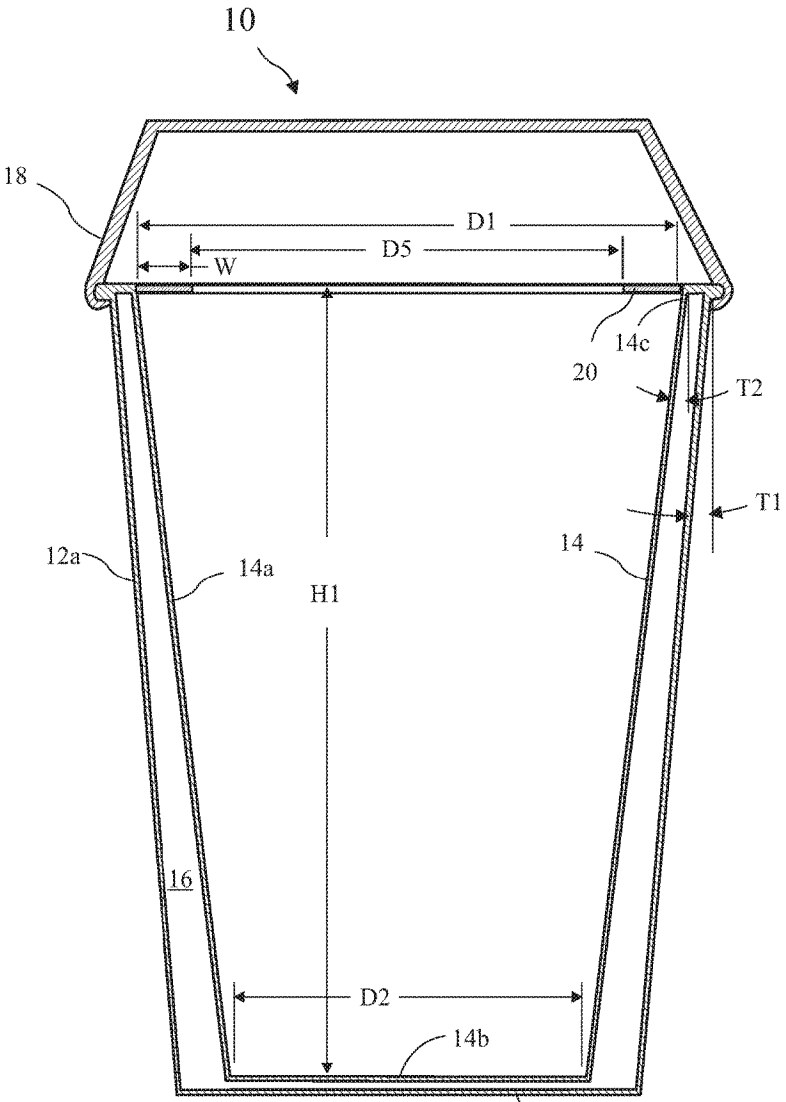
FIG. 2 is a cross-sectional view of the insulated cup holder according to the present invention taken along line 2-2 of FIG. 1.
Figure 1:
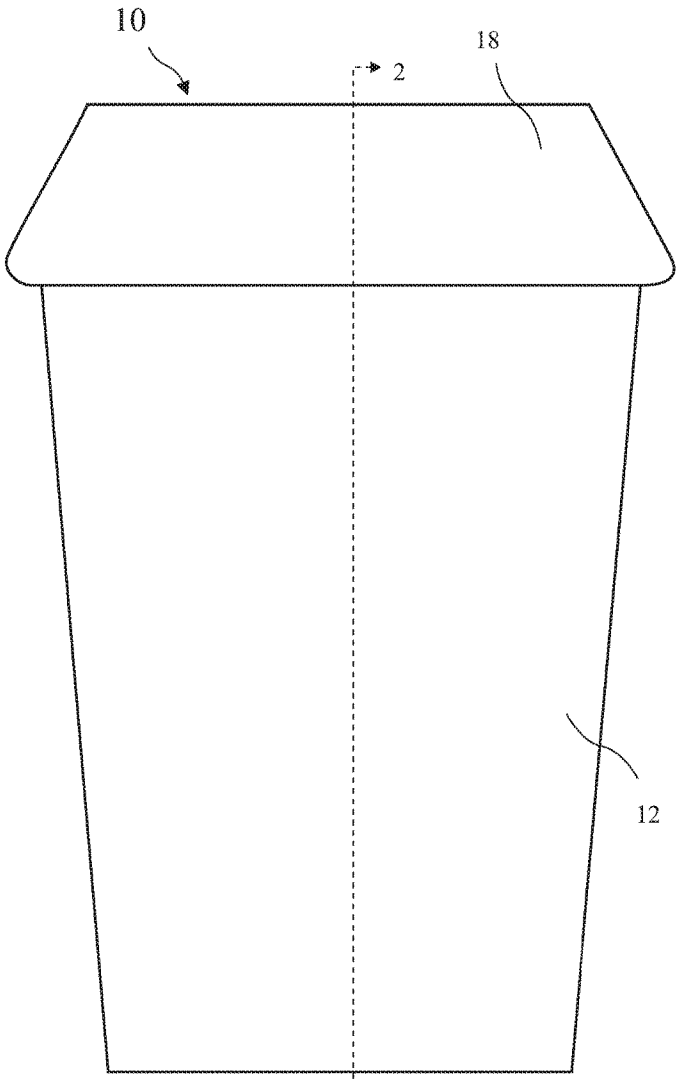
FIG. 1 is a side view of an insulated cup holder according to the present invention.

A side view of an insulated cup holder 10 according to the present invention is shown in FIG. 1 and a cross-sectional view of the insulated cup holder 10 taken along line 2-2 of FIG. 1 is shown in FIG. 2. The insulated cup holder 10 includes an outer shell 12, an inner shell 14, and optionally a lid 18. The outer shell 12 includes an outer wall 12*a* and a base 12*b*. The inner shell 14 resides inside the outer shell 12 and separated from the outer shell 12 by a first insulating volume (or gap) 16, and includes an inner shell wall 14*a*, an inner shell base 14*b*, and an inner shell top 14*c*. The outer and inner shells 12 and 14 preferably are only attached proximal to the inner wall top 14*c*. The volume 16 is preferably sealed from ambient air and may be partially evacuated to improve insulation. The inner shell had a height H1, a top diameter D1, and a bottom diameter D2.

An annular ring 20 resides inside the inner shell top 14*c* of the inner shell 14, and has an inside diameter D5 and a width W. The annular ring 20 is preferably made from silicone or a similar material. The lid 18 is preferably a domed lid providing space for a portion of the cup 30 extending above the top of the shells 12 and 14. The outer shell walls 12*a* are tapered at a first taper T1, and the inner shell walls 14*a* are tapered at a second taper T2. The taper T2 may be a greater taper than the taper T1, or they may be the same taper.

Figure 4:
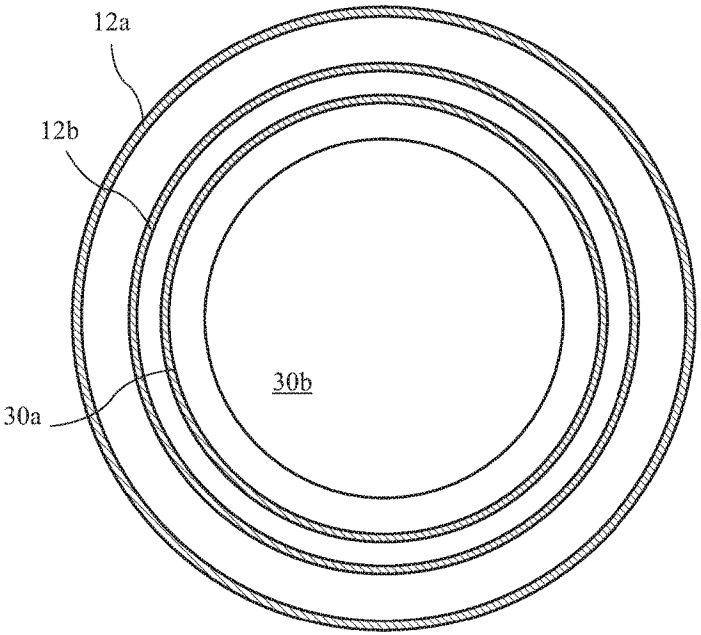
FIG. 4 is a cross-sectional view of the insulated cup holder according to the present invention taken along line 4-4 of FIG. 3.
Figure 3:
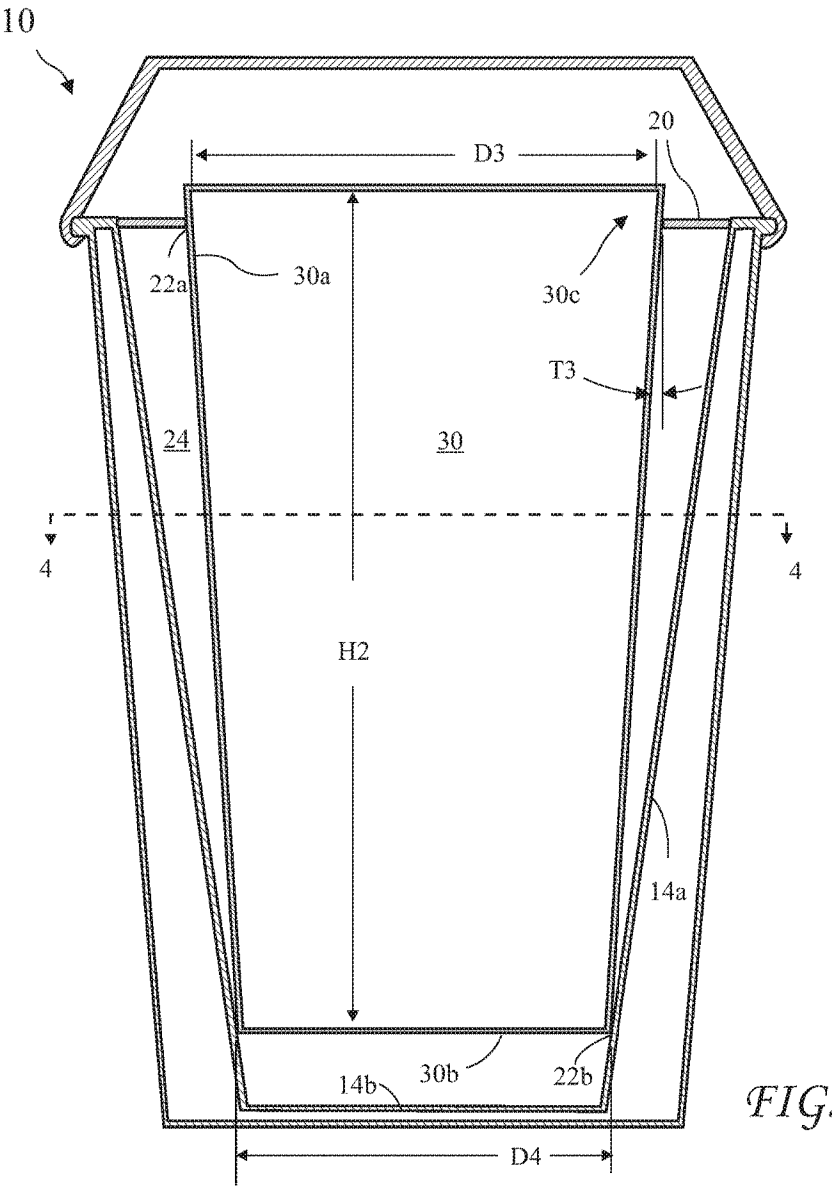
FIG. 3 is a cross-sectional view of the insulated cup holder according to the present invention holding a cup taken along line 2-2 of FIG. 1.

A cross-sectional view of the insulated cup holder 10 holding a cup 30 taken along line 2-2 of FIG. 1 is shown in FIG. 3 and a cross-sectional view of the insulated cup holder 10 taken along line 4-4 of FIG. 3 is shown in FIG. 4. The cup 30 includes a cup top 30*c* having a greater diameter than an inside diameter D5 of the annular ring 30 (see FIG. 2). Sides 30*a* of the cup 30 engage the annular ring 20 with an interference fit to position the top of the cup 30 in the holder 10 and seal a volume 24 between the cup 20 and the inner shell 14. Additionally, the taper T2 (see FIG. 2) of the inner shell walls 14*a* is greater than a taper T3 of the cup 30, and as a result, the bottom 30*b* of the cup 30 rests against the walls 14*a* of the inner shell 14, and above the base 14*b* of the inner shell 14. The cooperation of the inner shell walls 14*a* and the cup walls 30*a* position the cup 30 in the base 10 provides the volume 24 between the cup 30 and inner shell 14 to further insulate the cup 30, and holds the cup bottom 30*b* above the inner shell bottom 14*b* providing a more stable fit of the cup 30 into the holder 10 than provided when the bottom of the cup 30 rests against the bottom of the cup holder 10. The cup 30 has a height H2, a top diameter D3, and a bottom diameter D4. The diameter D4 is preferably greater than the diameter D2 (see FIG. 2) so that the cup bottom 30*b* does not reach the inner shell bottom 14*d* when the cup 30 resides in the cup holder 10. In one embodiment, the height H2 is less than the height H1 and the cup 30 resides under the lid 18 when in the cup holder 10.

While the invention herein disclosed has been described by means of specific embodiments and applications thereof, numerous modifications and variations could be made thereto by those skilled in the art without departing from the scope of the invention set forth in the claims.

I claim:

1. An insulated cup holder, comprising:
an outer shell;
an inner shell; and
a ring;
wherein the outer shell includes:
an outer shell sidewall; and
an outer shell base having a periphery fixed to a distal edge of the outer shell sidewall;
wherein an inside surface of the outer shell sidewall and an inner surface of the outer shell base define an interior space of the outer shell; and
wherein an area defined by an upper peripheral proximal edge of the outer shell sidewall is larger than an area of the outer shell base, such that the outer shell sidewall tapers from the upper peripheral proximal edge of the outer shell sidewall to the outer shell base;
wherein the inner shell includes:
an inner shell sidewall: and
an inner shell base having a periphery fixed to a distal edge of the inner shell sidewall:
wherein an upper peripheral proximal edge of the inner shell sidewall defines an open end of the inner shell;
wherein an inside surface of the inner shell sidewall and an inner surface of the inner shell base define an open interior space of the inner shell; and
wherein an area defined by the upper peripheral proximal edge of the inner shell sidewall is larger than an area of the inner shell base, such that the inner shell sidewall tapers from the upper peripheral proximal edge of the inner shell sidewall to the inner shell base; and
wherein an upper end of the inner shell is attached to an upper end of the outer shell and the inner shell is disposed within the interior space of the outer shell such that neither of the inner shell sidewall and the inner shell base is in contact with either of the outer shell sidewall and the outer shell base; wherein the ring is coupled to and extends inward from the inner shell at the open end of the inner shell; and
wherein an amount of the taper of the inner shell sidewall is greater than an amount of the taper of the outer shell sidewall.

2. The insulated cup holder of claim 1, wherein the inner shell and the outer shell are mutually attached only at the upper end of the inner shell and the upper end of the outer shell.

3. The insulated cup holder of claim 1, wherein the inner shell and the outer shell are mutually attached over a continuous surface so as to form a closed volume between the inner shell and the outer shell.

4. The insulated cup holder of claim 3, wherein the inner shell and the outer shell are mutually attached over a continuous sealed surface so as to form the closed volume between the inner shell and the outer shell.

5. The insulated cup holder of claim 1, further comprising a lid that is removably attachable to the outer shell.

6. A cup and insulated cup holder arrangement, comprising:
the insulated cup holder of claim 1; and
a cup;
wherein the cup includes:
a cup sidewall; and
a cup base having a periphery fixed to a distal edge of the cup sidewall;
wherein the cup sidewall is shorter than the inner shell sidewall; and
wherein an area of the cup base is smaller than the area defined by the upper peripheral proximal edge of the inner shell sidewall.

7. The cup and insulated cup holder arrangement of claim 6, wherein the area defined by an upper peripheral edge of the cup sidewall is larger than the area of the cup base, such that the cup sidewall tapers smaller from the upper peripheral edge of the cup sidewall to the cup base.

8. The cup and insulated cup holder arrangement of claim 7, wherein an amount of the taper of the inner shell sidewall is greater than an amount of the taper of the cup sidewall.

9. The cup and insulated cup holder arrangement of claim 8, wherein the cup is disposed within the interior space of the inner shell such that the periphery of the cup base is supported by the inside surface of the inner shell sidewall.

10. The cup and insulated cup holder arrangement of claim 6, wherein an area of the cup base is larger than an area of the inner shell base.

11. The cup and insulated cup holder arrangement of claim 10, wherein the cup is disposed within the interior space of the inner shell such that the periphery of the cup base is supported by the inside surface of the inner shell sidewall.

12. The insulated cup holder of claim 1, wherein the ring includes silicone.

13. A cup and insulated cup holder arrangement, comprising:
the insulated cup holder of claim 1; and
a cup;
wherein the cup includes:
a cup sidewall; and
a cup base having a periphery fixed to a distal edge of the cup sidewall;
wherein the cup sidewall is shorter than the inner shell sidewall; and
wherein an area of the cup base is smaller than the area defined by the upper peripheral proximal edge of the inner shell sidewall.

14. The cup and insulated cup holder arrangement of claim 13, wherein the area defined by an upper peripheral edge of the cup sidewall is larger than the area of the cup base, such that the cup sidewall tapers from the upper peripheral edge of the cup sidewall to the cup base.

15. The cup and insulated cup holder arrangement of claim 13, wherein an amount of the taper of the inner shell sidewall is greater than an amount of the taper of the cup sidewall.

16. The cup and insulated cup holder arrangement of claim 15, wherein the cup is disposed within the interior space of the inner shell such that the periphery of the cup base is supported by the inside surface of the inner shell sidewall.

17. The cup and insulated cup holder arrangement of claim 13, wherein an area of the cup base is larger than an area of the inner shell base.

18. The cup and insulated cup holder arrangement of claim 17, wherein the cup is disposed within the interior space of the inner shell such that the periphery of the cup base is supported by the inside surface of the inner shell sidewall.

19. The cup and insulated cup holder arrangement of claim 13, wherein an inner diameter of the ring is substantially the same as a diameter of the cup sidewall.

20. The insulated cup holder of claim 1, wherein the inner shell sidewall continuously tapers from the upper peripheral proximal edge of the inner shell sidewall to the inner shell base.

21. The insulated cup holder of claim 1, wherein the inner shell and the outer shell are mutually attached only at the upper peripheral proximal edge of the inner shell and the upper peripheral proximal edge of the outer shell.

22. The insulated cup holder of claim 1, wherein the ring has a closed annular shape.

23. The cup and insulated cup holder arrangement of claim 13, wherein engagement of the ring with the cup sidewall seals a volume between the cup sidewall and the inner shell.

* * * * *